US006018886A

United States Patent [19]

Bell et al.

[11] Patent Number: 6,018,886

[45] Date of Patent: Feb. 1, 2000

[54] EFFECT OF AIR BAFFLE DESIGN ON MOTTLE IN SOLVENT COATINGS

[75] Inventors: Brent C. Bell, Fairport; George M. Cline, Jr., Webster; Christopher J. Klasner, Rochester, all of N.Y.

[73] Assignee: Eastman Kodak Company, Rochester, N.Y.

[21] Appl. No.: 08/671,022

[22] Filed: Jun. 25, 1996

[51] Int. Cl.[7] ..... F26B 7/00

[52] U.S. Cl. ..... 34/380; 34/422; 34/463; 34/465; 34/621; 34/641; 34/642; 34/655

[58] Field of Search ..... 34/380, 414, 422, 34/429, 444, 459, 463, 465, 487, 621, 641, 642, 652, 653, 655; 226/95, 196.1

[56] References Cited

U.S. PATENT DOCUMENTS

| | | | |
|---|---|---|---|
| 1,776,609 | 9/1930 | Andrews . | |
| 3,982,328 | 9/1976 | Gustafsson et al. | 34/641 |
| 4,365,423 | 12/1982 | Arter et al. | 34/23 |
| 4,999,927 | 3/1991 | Durst et al. | 34/23 |
| 5,105,562 | 4/1992 | Hella et al. | 34/156 |
| 5,524,363 | 6/1996 | Seidl et al. | 34/641 |

OTHER PUBLICATIONS

Miller, C.A. and Neogi, P.; "Interfacial Phenomena". 1995.

Gutoff, E.B. and Cohen, D.C. "Coating and Drying Defects". 1995.

*Primary Examiner*—Henry Bennett
*Assistant Examiner*—Steve Gravini
*Attorney, Agent, or Firm*—Arthur H. Rosenstein

[57] ABSTRACT

Apparatus for drying coated web material and preferably moving web material comprises a nozzle, means for supplying air to the nozzle and means to distribute the air through said nozzle substantially uniformly across the web width, said nozzle arcing from a position perpendicular with respect to the plane of the web to a position substantially parallel with respect to the plane of the web, said nozzle having an exit slot wherein the air is discharged from the exit slot at an angle of between 1° and 45° with respect to the plane of the web.

14 Claims, 3 Drawing Sheets

EFFECT OF AIR BAFFLE DESIGN ON MOTTLE IN SOLVENT COATINGS

FIELD OF THE INVENTION

This relates to apparatus and method for drying coated webs and, more particularly to the drying of mottle sensitive coatings on film base such as photographic film and paper.

BRIEF DESCRIPTION OF THE PRIOR ART

One of the most common defects associated with organic solvent coatings is mottle. Direct impingement air can cause mottle by disturbing the coating. Also, the heat transfer uniformity is critical. Local variations in heat transfer will show up as mottle. Even if coatings are allowed to dry without direct air impingement, the shear forces caused by the web moving through still air can cause mottle. This will limit the speed at which a product can be manufactured. The occurrence of mottle is often cited as the single greatest limitation to productivity improvement in the drying of coated webs. In order to produce acceptable coatings, web speeds are often reduced significantly from what the machine is capable of coating and drying.

Mottle patterns can range from random and blotchy to "liney-streaky" depending on the coating and process conditions. Typically in photographic film and paper, mottle becomes more severe and oriented in the direction of web travel as web speed is increased. Sensitive products can be limited to web speeds of around 150 feet per minute (fpm). Coatings can be made to be more robust to mottle by increasing the viscosity of the solutions and decreasing the wet thickness of the coating (concentrating the solution) such as described in Miller, C. A. and Neogi, P.; "*Interfacial Phenomena*"; Marcel Decker; 1995 but, this is not always possible because of coatability or solution stability concerns.

When the coating solutions cannot be made to be robust to mottle, disturbances to the coating created in the coating and drying machine must be minimized in order to produce acceptable coatings. One of the most important disturbances is air. Air can directly disturb a wet coating if the pressure or shear forces are great enough (Gutoff, E. B. and Cohen, D. C.; "*Modern Coating and Drying Technology*"; J. Wiley and Sons; p. 289; 1995). This would represent coating blow around. Even if the pressure and shear forces are not great enough to blow the coating around, non-uniformities in the air velocity impinging on the coating can cause surface tension driven flow. Surface tension driven flow arises as a result of variations in concentration and temperature along the surface of the coating. Non-uniform air flow can cause local variations in heat and mass transfer rates which in turn cause concentration and temperature variations.

In the last several years there have been only a limited number of published reports on the reduction of mottle by controlling air flow in a solvent coating machine. In 1982, Arter and Barbee, "Method and Apparatus for Drying Coated Sheet Material", U.S. Pat. No. 4,365,423, 1982 described the concept of using two-layer screens very close to the coating to protect it from air disturbances and to raise the local solvent concentrations in the gas. Durst, et al "Process and Device for Drying a Liquid Applied to a Moving Carrier Material", U.S. Pat. No. 4,999,927; 1991, proposed a drier design that promotes parallel air flow near the web by creating an air suction near the web and down in the machine. This design does not employ air baffles and has the disadvantage that the fan must be located a fixed distance from the coater and this may itself represent a speed limitation since the coating must be "dry" by the time it passes the fan or the non-uniform air flow that exists there may cause mottle. A more flexible option would be to use air baffles so that the length of the laminar air flow region within the machine is not fixed and hence there would be no restriction on speed as a result of the dry point location. In 1992, Hella and Buchanan, U.S. Pat. No. 5,105,562, described a ventilating and impinging air bar assembly primarily for improved conveyance but, this design relies on direct front side air impingement which is, in general, not desirable from the standpoint of minimizing mottle.

Generally the drying of coated webs is accomplished by direct impingement of air from a nozzle wherein the air is supplied perpendicular to the place of the coated web. Using this technique, mottle occurs in the coating.

U.S. Pat. No. 1,776,609 issued to Andrews on Sep. 23, 1930 discloses a web drying apparatus that consists of nozzles which discharge heated air onto a deflector member. The air is discharged in the direction of the web and the discharge velocity is high to provide a large heat transfer. There is no mention of mottle control or matching of air velocity to web velocity.

U.S. Pat. No. 5,105,562 issued to Hella et al on Apr. 21, 1992 discloses a web drying apparatus which consists of a direct impingement air bar discharging air against the coated surface and a dilution air bar mounted on both sides of the impingement bar. This configuration provides both parallel (to the web travel) air flow and counter (to the web travel) air flow. The direct impingement and dilution bars are supplied air independently of each other. There is no mention of trying to match the air velocity to web velocity to control coating mottle.

SUMMARY OF THE INVENTION

It is an object of this invention to provide apparatus and a method for drying coated webs without causing mottle.

It is a further object of this invention to dry mottle sensitive solvent coatings such as photographic coatings at higher speeds than the conventional nozzle drying apparatus by eliminating the shear effects of the coated web as it passes through the air in a dryer.

These and other objectives are achieved using an apparatus for drying coated web material comprising a nozzle, means for supplying air to the nozzle and means to distribute the air through said nozzle substantially uniformly across the web, said nozzle arcing from a position substantially perpendicular with respect to the plane of the web to a position substantially parallel with respect to the plane of the web, said nozzle having an exit slot wherein the air is discharged from the exit slot at an angle of between 1° and 45° with respect to the plane of the web.

In a further embodiment of the present invention, a method for drying a coated web comprising passing air over the coated surface of said web by a nozzle which is arced from a position perpendicular with respect to the plane of the web to a position parallel with respect to the plane of the web wherein an outlet slot at the end of the nozzle is positioned such that the air discharge from said exit slot is at an angle of between 1 and 45° with respect to the plane of the web.

In a still further embodiment of the present invention, the method above includes minimizing the difference between the air velocity and the web velocity. This minimizes shear forces between the moving web and the air in contact with the coated surface. This, in turn, minimizes coating mottle, particularly with mottle-sensitive coatings. This is accomplished by matching as close as possible, the air velocity to the web speed.

DESCRIPTION OF THE PREFERRED EMBODIMENTS

Figure 1:
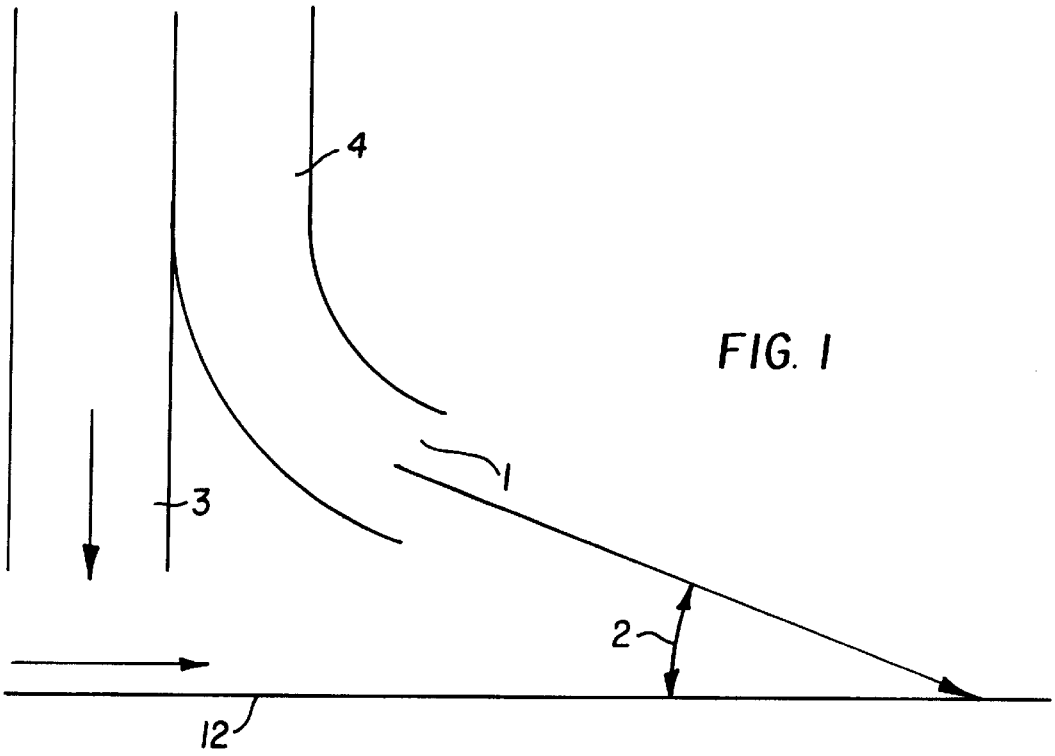
FIG. 1 is an enlarged detail of a nozzle in a vertical cross sectional view.
Figure 2:
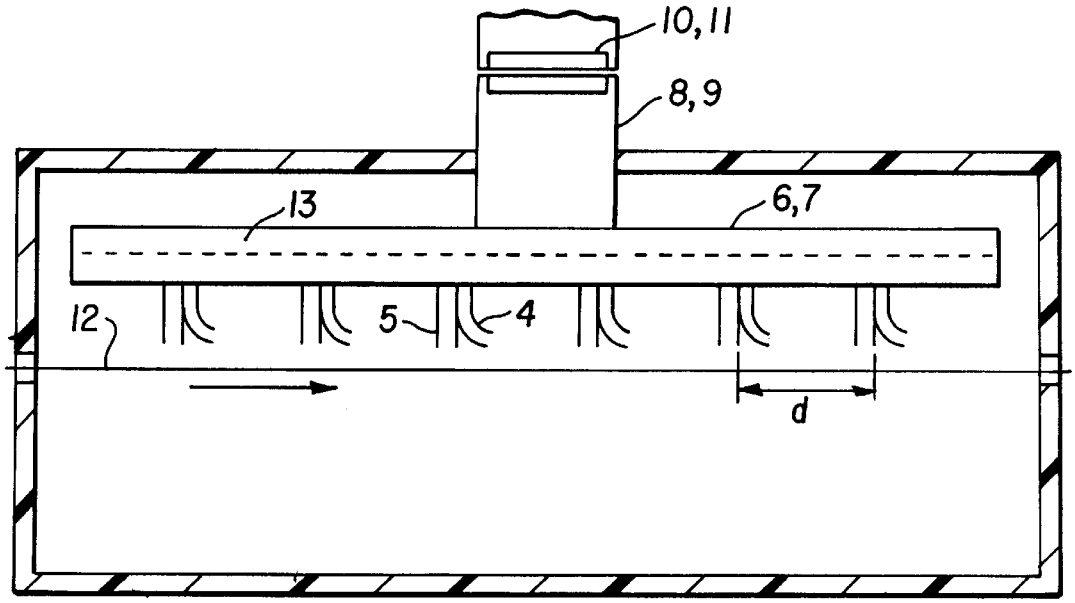
FIG. 2 is a schematic vertical cross sectional view of the dryer enclosure showing the nozzle arrangements located above the top, coated side of the web.

In the present embodiment of the invention, the web, preferably is coated on the top side only. The web could be polyethylene terephthalate (PET), polyethylene naphthalate (PEN), acetate, or paper. The coating is generally a solvent coating and in a particularly preferred embodiment, is a photographic coating composition such as consisting of polymers such as polyvinyl butyral resin (Butvar) and cellulose acetate and solvents such as methylene chloride, methyl ethyl ketone, such as used for subbing layers for light sensitive emulsions, and the like. As illustrated in FIG. 1, when coating product in which mottle is undesirable, the air is introduced from the arced nozzle and only when the nozzle is at a position relatively parallel to the plane of the web at approximately the same speed as the web. The angle (2) at which the air is introduced from the exit slot (1) of the nozzle (4) is very important. Generally the nozzle is arced from a perpendicular position with respect to the plane of the web (12) to a substantially parallel position with respect to the plane of the web and the angle of the air discharged from the exit slot (1) is between 1° and 45° with respect to the plane of the web. Too large of a vertical component and the coating could be disturbed. If the coating can tolerate some direct impingement, air can be introduced by the attached direct impingement nozzle (3). The nozzles are typically spaced at an interval of 6 to 24 inches depending on the process conditions (as shown in FIG. 2).

The conveyance used on the bottom (uncoated) side of the web is not shown, although it is preferred that the coated web be moving at a line speed above 500 fpm. As shown in FIG. 2, the coated web (12) passes through the dryer enclosure under the slots of nozzle (4) supplied by air from supply air duct (9) and direct impingement nozzle (5) supplied by air from supply air duct (8). In a preferred embodiment of this invention, the nozzle supplying air to the web at a position perpendicular to the plane of the web is used along with the arced nozzle. Both nozzles are independently supplied by different supply air plenums (6 & 7). A perforated distribution plate (13) is used to ensure uniform air flow from the downstream nozzles. The air pressure can be independently controlled by the pivoting air dampers (10 & 11) in the supply air ducts (8 & 9). This allows the same machine to coat a variety of products without sensitivity to dry point location.

Figure 3:
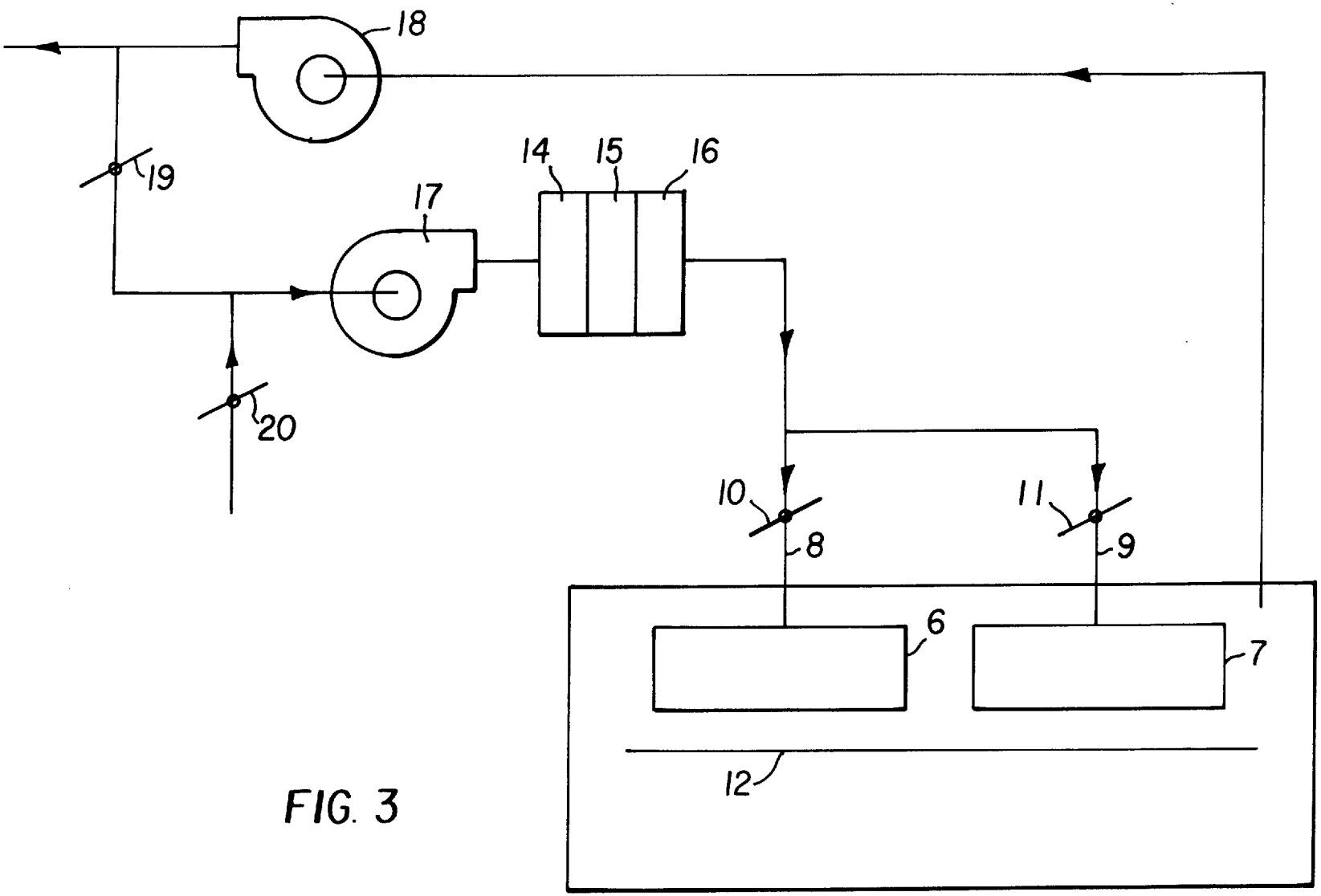
FIG. 3 is a schematic diagram of the process of this invention.

FIG. 3 illustrates the preferred process flow. Air is supplied by the supply air fan (17) which is obtained from an exhaust air fan (18) through a recirculate damper (19) assisted by make-up air damper (20) and conditioned by either the cooling (14) or heating (15) coils and then cleaned by the filters (16). It is often preferred to supply the air at temperatures between 2° C. and 150° C. The air pressure is controlled by the supply air dampers (10,11) and is determined by the desired heat transfer rate and product sensitivity to coating mottle. The supply air ducts (8 & 9) deliver the air to the independent supply air plenums (i.e. direct impingement or dilution) (6 & 7). The air then passes through the perforated distribution plate (13) as shown in FIG. 2 to ensure uniform discharge velocities from the exit of the nozzles.

In a particularly preferred embodiment of this invention, a plurality of arced nozzles is used. The preferred arced nozzle spacing (d) in FIG. 2, is between 6 and 24 inches, more preferably between 6 and 18 inches. The vertical nozzles of the prior art may also be used substantially adjacent said arced nozzles.

The following example illustrates the advantages of the use of the arced nozzle to dry a coated web.

EXAMPLE

In this work, five different air baffle designs were evaluated experimentally to see their effect on mottle. These designs vary greatly in the character of air flow they produce near the web. The next section describes these air baffles and the experimental run. This is followed by experimental results.

Figure 4:
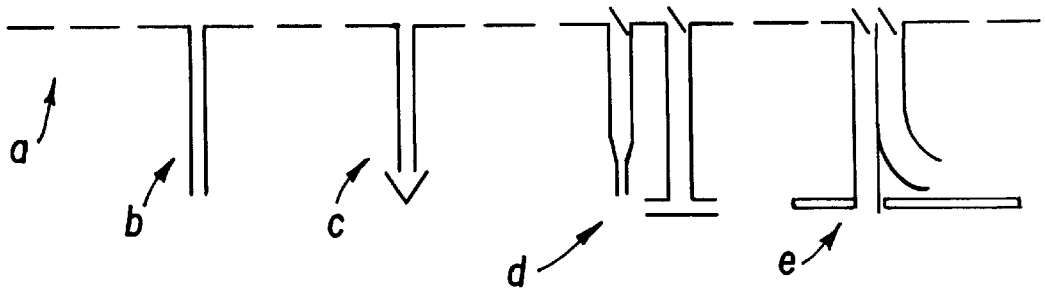
FIG. 4 is a schematic of different types of air nozzles.

In order to examine the effect of air baffle geometry on the level and character of mottle in solvent coatings, a total of five different air baffles were built and tested. These are shown in FIG. 4. Design d is a commercially available nozzle.

The slot and extended slot designs supply air normal to the web while the V-channel is specifically designed to feed air to the chamber with very little direct impingement onto the coating. The commercially available and arced designs are capable of delivering both normal and parallel air flows. The main difference between the commercially available design and arced slots are that the arced slots provide less than parallel air flow in one direction only and have removable screens.

All coatings in this work were made using a pilot machine. FIG. shows a side view of the machine from the hopper to the end of the 30" long dryer section with V-channels. The plenums were 4" long and were suspended by rods so that the plenum to web spacing could be varied from 6 to 24 inches.

Figure 5:
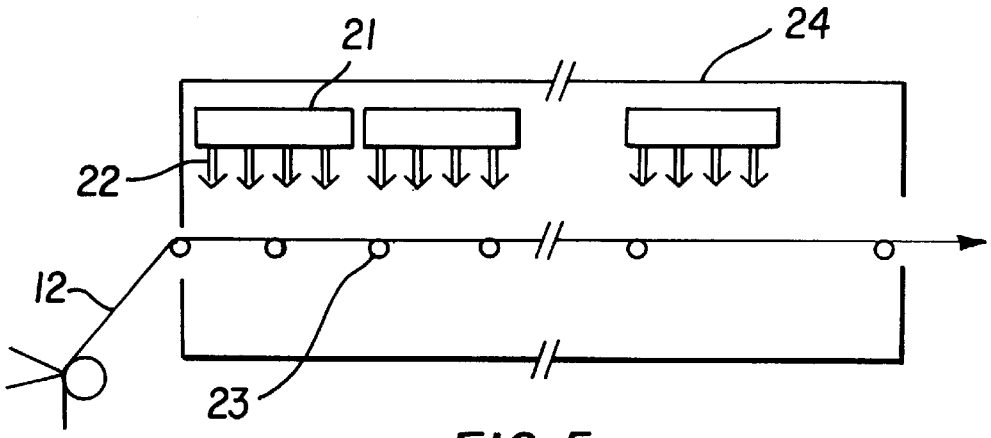
FIG. 5 is a side view of a typical machine dryer section.

In FIG. 5, web (12) is preferably dried by moving web (12) through a dryer (24) comprising plenums (21) with baffles (26). The web is conveyed over rollers (23) and dried therein.

The coating solution was made up of polyvinyl butyral resin (Butvar 76) in a 50:50 mixture of Toluene and MEK. A small amount of magenta dye was also added to make any mottle patterns visible. The weight percentage of Butvar was varied between 1 and 7% by pumping from two different containers and mixing the solutions just before the hopper. Temperatures of the coating solutions, hopper, support and dryer section were 75° F. for all coatings. The pressure differential between the outside of the machine and the dryer section was held at −0.0025 in $H_2O$ (slightly negative for safety). A 4½ inch wide slot coater was used to apply the coating to unsubbed, 5 inch wide, 4 mil PET.

For each baffle design, a series of coatings were made to evaluate its affect on mottle. First, a speed series was performed to see the change in mottle with speed for each design. For a given baffle design, baffle to web spacing, and pressure drop across the baffle, the speed was increased from 100 to 500 fpm in steps of 100 fpm while coating a 3% Butvar solution with a wet coverage of 4.5 cc/ft$^2$. The viscosity of a 3% solution is about 5 cp.

A 5 cp, 45 cc/M$^2$ coating was chosen because it was extremely sensitive to air flow induced mottle. This coating could therefore be used to visualize and record the effect of the air flow from each baffle design on the change in size and orientation of the mottle pattern. In addition to the speed series, coatings were made with 1 to 7% Butvar and with 25 and 65 cc/M$^2$ wet coverage to see how changing the coating parameters affect the mottle pattern produced by each baffle design.

Figure 6:
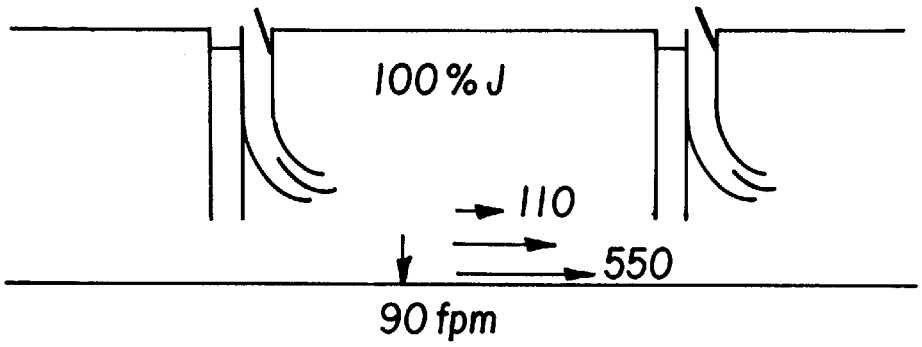
FIG. 6 is a schematic of air velocities produced by the present invention.

With each baffle design installed and pressure differentials set across the baffles and between the outside and inside of the dryer section, a hand held hot wire anemometer was used to measure air velocities near the web. FIG. 6 shows the air velocities for the arced slot design without screens and with 100% of the air coming out of the arced side. The angle of the area was 30°. In this case the air velocity normal to the web is low but the parallel velocity is high and in the direction of web travel.

Table 1 shows the average normal and parallel air velocities for each baffle design along with the resulting heat transfer coefficients. The range given for each entry is a result of varying the pressure drop across the baffles from 0.07 to 0.33 inches of Wg. The heat transfer coefficients were calculated from dry point measurements. From Table 1 it can be seen that the slots, V-channel, commercially available design (100%T), and arced slots with screens all had nearly the same air flows. The extended slots, however, produced a much higher direct impingement than any other design while the arced slot without screens was the only design that produced a high parallel velocity.

TABLE 1

| Baffle | Average Air Velocities Near Web (fpm) | | Heat Transfer Coefficient |
|---|---|---|---|
| Configuration | Normal | Parallel | (BTU/hr ft$^2$ F) |
| Slots | 50–70 | 100–200 | 6.1 |
| V-Channel | 30–60 | 100–200 | 3.5 |
| Extended slots | 350–600 | 100–200 | 10.1 |
| Commercially Available Design T | 30–60 | 100–200 | 4.3 |
| Arced slot w/o screens | 50–100 | 400–700 | 5.7 |
| Arced slot with screens | 30–70 | 150–250 | 4.3 |

There were significant differences between the mottle patterns produced by the different baffles, especially at high web speeds. It was seen that the mottle pattern for the V-channel is random at 100 fpm but becomes oriented in the direction of web travel at 500 fpm. The results for the slot design were essentially the same. The patterns produced by the screened arced slots and by the commercially available design with all the air coming out of the "T" produce more orientation at higher web speeds. In fact, these 500 fpm samples are similar in appearance to samples for certain products at web speeds of around 500 fpm. This pattern is often referred to as "liney-streaky" mottle.

This trend of more orientation at high web speeds is reversed for the arced slot design without screens. The 100 and 500 fpm samples produced with this design show at 100 fpm the pattern is strongly oriented in the direction of web travel (slightly outward). At 500 fpm though, the low level mottle pattern is completely random and the liney-streakiness at high speed has been eliminated.

In the case of the arced slots, the relative velocity difference between the web and the air decreases as web speed increases. In fact, at 500 fpm the web and air speeds are within 50 fpm of each other. As a result, the amount of non-uniform air flow over the wet surface is greatly reduced and the low level mottle pattern shows no orientation. With these results it seems that moving the air uniformly along the web acts to reduce air disturbances significantly which is highly desirable, especially in the early part of the machine. In order to further demonstrate the effect of web/air relative velocity differences, the arced slots without screens were turned against the direction of web travel and a speed series was performed. The resulting mottle patterns were severely oriented at all web speeds.

In comparison, high direct impingement was investigated using the extended slot design. Liney-streaky mottle was produced at web speeds between 100 and 500 fpm.

Increasing the viscosity of the coating solutions made the coating less sensitive to air flow as expected. Although even at 30 cp (7% B-76) orientation at high web speed was still present for all but the arced slots without screens. Increasing coated wet thickness made the mottle pattern worse in all cases, again as expected.

Images of the coating taken at the end of the dryer section showed that the mottle pattern was completely formed by that point (at least over the range of web speeds, wet coverages, viscosities and solvents that were used in this work). This was confirmed by comparing these images with the corresponding images taken of the dry samples.

The invention has been described in detail with particular reference to preferred embodiments thereof, but it will be understood that variations and modifications can be effected within the spirit and scope of the invention.

What is claimed is:

1. Apparatus for drying coated web material comprising a nozzle, means for supplying air to the nozzle and means to distribute the air through said nozzle substantially uniformly across the web, said nozzle arcing from a position substantially perpendicular with respect to the plane of the web to a position substantially parallel with respect to the plane of the web, said nozzle having an exit slot wherein the air is discharged from the exit slot at an angle of between 1° and 45° with respect to the plane of the web said arc being only in the same direction as that of the web so that said arc is both parallel to and in the same direction as the web.

2. The apparatus of claim 1 wherein said means for supplying air is by supply air ducts.

3. The apparatus of claim 1 wherein said means for distributing air is a fan.

4. The apparatus of claim 1 wherein the angle of said arc is 30°.

5. The apparatus of claim 1 containing greater than 2 arced nozzles, being spaced apart from 6 to 24 inches.

6. The apparatus of claim 1 further comprising one or more nozzles which deliver air perpendicularly to the plane of the web.

7. The apparatus of claim 6 wherein each of the nozzles which deliver air perpendicular to the web is positioned substantially adjacent to an arced nozzle.

8. A method for drying a moving coated web comprising passing air over the coated surface of said web by a nozzle which is arced from a position perpendicular with respect to the plane of the web to a position parallel with respect to the plane of the web wherein an outlet slot at the end of the nozzle is positioned such that the air discharge from said exit slot is at an angle of between 1 and 45° with respect to the plane of the web said arc being only in the same direction as that of the web so that said web is both parallel to and in the same direction of the web.

9. The method of claim 8 wherein the air is distributed to said nozzle by a fan.

10. The method of claim 8 wherein the angle of said arc is 30°.

11. The method of claim 8 wherein greater than 1 arced nozzles are used, said arced nozzles being spaced apart from 6 to 24 inches.

12. The method of claim 8 wherein the web is also treated by one or more nozzles which deliver air perpendicularly to the plane of the web.

13. The method of claim 12 wherein each of said additional nozzles which deliver air perpendicularly to the plane of the web is positioned substantially adjacent to an arced nozzle.

14. The method of claim 8 wherein the air speed emitted from the slot of the arced nozzle is substantially equal to the speed of the moving web.

* * * * *

UNITED STATES PATENT AND TRADEMARK OFFICE

CERTIFICATE OF CORRECTION

PATENT NO. : 6,018,886
DATED : February 1, 2000
INVENTOR(S) : Brent C. Bell, et al It is certified that error appears in the above-identified patent and that said Letters Patent is hereby corrected as shown below:

| | |
|---|---|
| Column 4, line 41 | Please add --5-- after the word "FIG". |
| Column 4, line 42 | Please delete [30"] and replace with --30'--. |
| Column 4, line 43 | Please delete [4"] and replace with --4'--. |

Signed and Sealed this

Twentieth Day of February, 2001

*Attest:*

Nicholas P. Godici

NICHOLAS P. GODICI

*Attesting Officer*

*Acting Director of the United States Patent and Trademark Office*